US011359505B2

(12) United States Patent
Read et al.

(10) Patent No.: US 11,359,505 B2
(45) Date of Patent: Jun. 14, 2022

(54) NESTING CMC COMPONENTS

(71) Applicant: United Technologies Corporation, Farmington, CT (US)

(72) Inventors: Kathryn S. Read, Marlborough, CT (US); Andrew J. Lazur, Laguna Beach, CA (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 271 days.

(21) Appl. No.: 16/403,535

(22) Filed: May 4, 2019

(65) Prior Publication Data

US 2020/0348025 A1 Nov. 5, 2020

(51) Int. Cl.

| | |
|---|---|
| ***F01D 11/08*** | (2006.01) |
| ***F01D 25/24*** | (2006.01) |
| ***F23R 3/00*** | (2006.01) |

(52) U.S. Cl.

CPC ..... *F01D 11/08* (2013.01); *F01D 25/24* (2013.01); *F23R 3/007* (2013.01); *F05D 2240/14* (2013.01); *F05D 2240/35* (2013.01); *F05D 2240/55* (2013.01); *F05D 2300/6033* (2013.01)

(58) Field of Classification Search

CPC ..... F01D 11/08; F01D 11/005; F01D 25/24; F01D 25/246; F01D 9/023; F05D 2300/6033; F05D 2240/11; F05D 2240/14; F05D 2240/35; F05D 2240/55; F23R 3/007; Y02T 50/60

See application file for complete search history.

(56) References Cited

U.S. PATENT DOCUMENTS 1,447,533 A * 3/1923 Chopieska ..... F16J 9/14 277/446
2,927,724 A * 3/1960 Wardle ..... F01D 11/08 415/113
3,899,876 A * 8/1975 Williamson ..... F23R 3/002 60/757
4,204,403 A * 5/1980 Howe ..... F23R 3/10 60/743
4,218,067 A * 8/1980 Hailing ..... F16J 15/021 277/605

(Continued)

FOREIGN PATENT DOCUMENTS

EP 1965031 9/2008
FR 2521217 A1 * 8/1983 ..... F02C 7/24

(Continued)

OTHER PUBLICATIONS

EP Search Report for EP Application No. 20171487.0 dated Oct. 14, 2020.

*Primary Examiner* — David E Sosnowski
*Assistant Examiner* — Wayne A Lambert
(74) *Attorney, Agent, or Firm* — Carlson, Gaskey & Olds, P.C.

(57) ABSTRACT

A component for a gas turbine engine includes a body that has a first circumferential side and a second circumferential side. A circumferentially extending passage extends from the first circumferential side to the second circumferential side. The first circumferential side has an outer height that is less than an inner height of the second circumferential side.

15 Claims, 5 Drawing Sheets

(56) References Cited

U.S. PATENT DOCUMENTS 4,395,195 A * 7/1983 De Cosmo ..... F01D 11/001 415/137
4,411,594 A * 10/1983 Pellow ..... F01D 25/246 415/173.3
5,374,161 A * 12/1994 Kelch ..... F01D 11/005 415/139
5,538,393 A * 7/1996 Thompson ..... F01D 11/08 415/115
5,636,508 A * 6/1997 Shaffer ..... F23R 3/007 60/753
6,237,921 B1 * 5/2001 Liotta ..... F01D 11/005 277/630
6,261,053 B1 * 7/2001 Anderson ..... F01D 11/04 415/115
6,352,267 B1 * 3/2002 Rode ..... F16J 15/0887 277/631
6,439,844 B1 * 8/2002 Turnquist ..... F01D 5/225 415/173.3
6,533,542 B2 * 3/2003 Sugishita ..... F01D 5/145 415/139
6,910,854 B2 * 6/2005 Joslin ..... F01D 5/225 415/139
8,206,092 B2 * 6/2012 Tholen ..... F01D 11/08 415/173.1
8,246,299 B2 * 8/2012 Razzell ..... F01D 11/005 415/173.1
9,051,846 B2 * 6/2015 Arilla ..... F01D 11/005
9,079,245 B2 7/2015 Durocher et al.
9,423,129 B2 * 8/2016 Graves ..... F23R 3/002
9,581,039 B2 * 2/2017 Renon ..... D03D 23/00
9,982,550 B2 * 5/2018 Davis ..... F01D 11/005
10,024,193 B2 7/2018 Shapiro
10,487,943 B2 * 11/2019 Davis ..... F16J 15/0887
10,876,429 B2 * 12/2020 Lefebvre ..... F01D 11/24
2004/0047725 A1 3/2004 Tomita et al.
2013/0156556 A1 * 6/2013 Franks ..... F01D 11/08 415/182.1
2016/0245102 A1 * 8/2016 Freeman ..... F01D 11/005
2017/0276000 A1 * 9/2017 Snider ..... F01D 11/10
2017/0328228 A1 11/2017 Ruthemeyer et al.
2018/0230839 A1 8/2018 Gallier et al.

FOREIGN PATENT DOCUMENTS

GB 2166805 5/1986
JP 2017145159 A * 8/2017 ..... F23R 3/42
WO 2015031764 3/2015

* cited by examiner

NESTING CMC COMPONENTS

BACKGROUND

This application relates to a ceramic matrix composite component assembly.

Gas turbine engines are known and typically include a compressor compressing air and delivering it into a combustor. The air is mixed with fuel in the combustor and ignited. Products of the combustion pass downstream over turbine rotors, driving them to rotate.

It is desirable to ensure that the bulk of the products of combustion pass over turbine blades on the turbine rotor. As such, it is known to provide blade outer air seals radially outwardly of the blades. Air flowing through the combustor and turbine has very high temperatures. Some of the components in these high temperature areas, such as the combustor segments and the blade outer air seals have been proposed to be made of ceramic matrix composite.

SUMMARY

In one exemplary embodiment, a component for a gas turbine engine includes a body that has a first circumferential side and a second circumferential side. A circumferentially extending passage extends from the first circumferential side to the second circumferential side. The first circumferential side has an outer height that is less than an inner height of the second circumferential side.

In a further embodiment of the above, the circumferentially extending passage is defined by a base portion, first and second axial walls, and an outer wall.

In a further embodiment of any of the above, the base portion extends axially forward of the first axial wall.

In a further embodiment of any of the above, the body is tapered from the second circumferential side to the first circumferential side.

In a further embodiment of any of the above, the tapered body defines an angle between the first circumferential side and the second circumferential side between about 0.1° and about 15°.

In a further embodiment of any of the above, a notch is arranged at the first circumferential side to define the outer height.

In a further embodiment of any of the above, the body is tapered from the second circumferential side to the first circumferential side and a notch is arranged at the first circumferential side to define the outer height.

In a further embodiment of any of the above, the body has a circumferential length between the first and second circumferential sides that is between about 2 and about 16 inches (50.8-406.4 mm).

In a further embodiment of any of the above, the circumferentially extending passage is defined by walls each having a thickness of about 0.02 to 0.25 inches (1.016-6.35 mm).

In a further embodiment of any of the above, a difference between the outer height and the inner height is about 0.02 to 0.3 inches (0.508-7.62 mm).

In a further embodiment of any of the above, the body is a ceramic matrix composite material.

In a further embodiment of any of the above, the body is formed from a plurality of fibrous woven or braided plies.

In another exemplary embodiment, a turbine section for a gas turbine engine includes a turbine blade that extends radially outwardly to a radially outer tip and for rotation about an axis of rotation. A blade outer air seal has a plurality of segments arranged circumferentially about the axis of rotation and radially outward of the outer tip. Each seal segment has a first circumferential side and a second circumferential side and a circumferentially extending passage. The first circumferential side is arranged partially within the circumferentially extending passage of an adjacent seal segment.

In a further embodiment of any of the above, each seal segment has a taper from the second circumferential side to the first circumferential side.

In a further embodiment of any of the above, the taper defines an angle between the first circumferential side and the second circumferential side between about 0.1° and about 15°.

In a further embodiment of any of the above, a notch is arranged at the first circumferential side to define the outer height In a further embodiment of any of the above, the first circumferential side has an outer height that is less than an inner height of the second circumferential side In a further embodiment of any of the above, the circumferentially extending passage is defined by a base portion, first and second axial walls, and an outer wall. The base portion extends axially forward of the first axial wall.

In a further embodiment of any of the above, the seal segment is a ceramic matrix composite material.

In another exemplary embodiment, a combustor section for a gas turbine engine includes a combustor chamber disposed about an engine central axis and formed from a plurality of segments. At least one of the segments has a first circumferential side and a second circumferential side and a circumferentially extending passage. The first circumferential side has a first radial height that is less than a second radial height of the second circumferential side.

DETAILED DESCRIPTION

Figure 1:
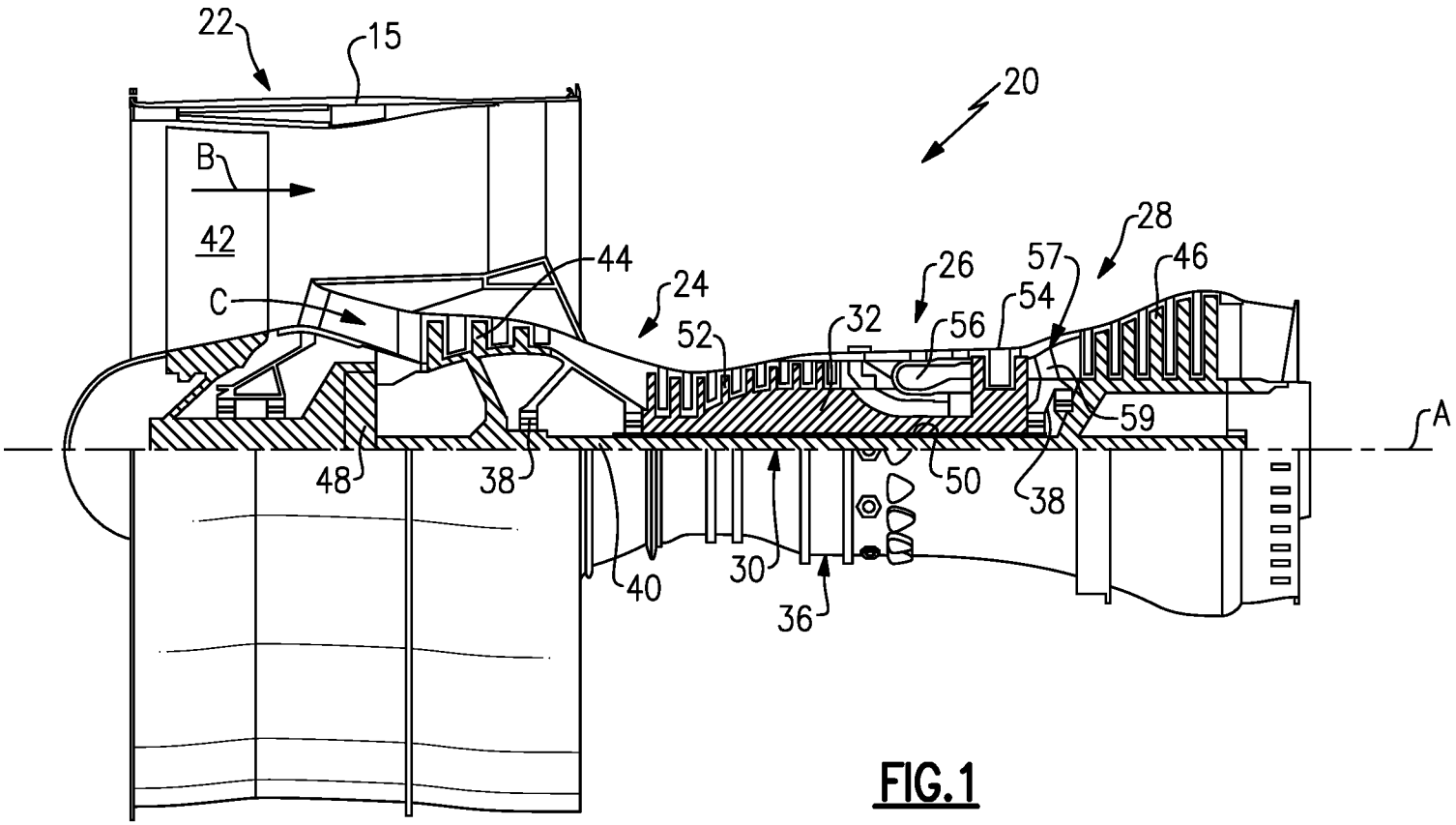
FIG. 1 schematically shows a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in the exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in the exemplary gas turbine engine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
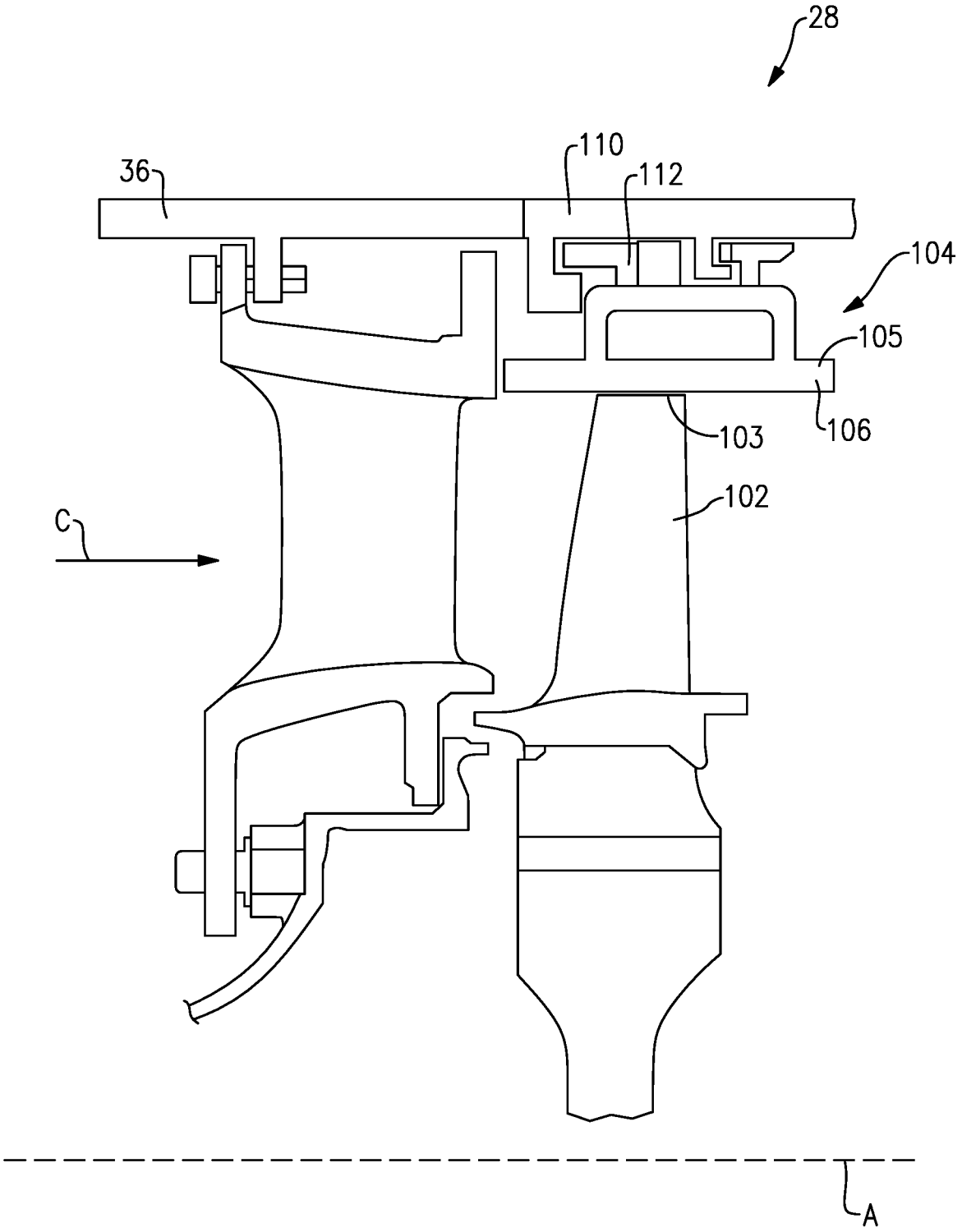
FIG. 2 shows an example turbine section.

FIG. 2 shows a portion of an example turbine section 28, which may be incorporated into a gas turbine engine such as the one shown in FIG. 1. However, it should be understood that other sections of the gas turbine engine 20 or other gas turbine engines, and even gas turbine engines not having a fan section at all, could benefit from this disclosure.

A turbine blade 102 has a radially outer tip 103 that is spaced from a blade outer air seal assembly 104 with a blade outer air seal ("BOAS") 106. The BOAS 106 may be made up of a plurality of seal segments 105 that are circumferentially arranged in an annulus about the central axis A of the engine 20. The BOAS segments 105 may be monolithic bodies that are formed of a high thermal-resistance, low-toughness material, such as a ceramic matrix composite ("CMC").

The BOAS 106 may be mounted to an engine case or structure, such as engine static structure 36 via a control ring or support structure 110 and/or a carrier 112. The engine structure 36 may extend for a full 360° about the engine axis A. The engine structure 36 may support the support structure 110 via a hook or other attachment means. The engine case or support structure holds the BOAS 106 radially outward of the turbine blades 102. Although a BOAS 106 is described, this disclosure may apply to other components, such as a combustor, inlet, or exhaust nozzle, for example.

Figure 3:
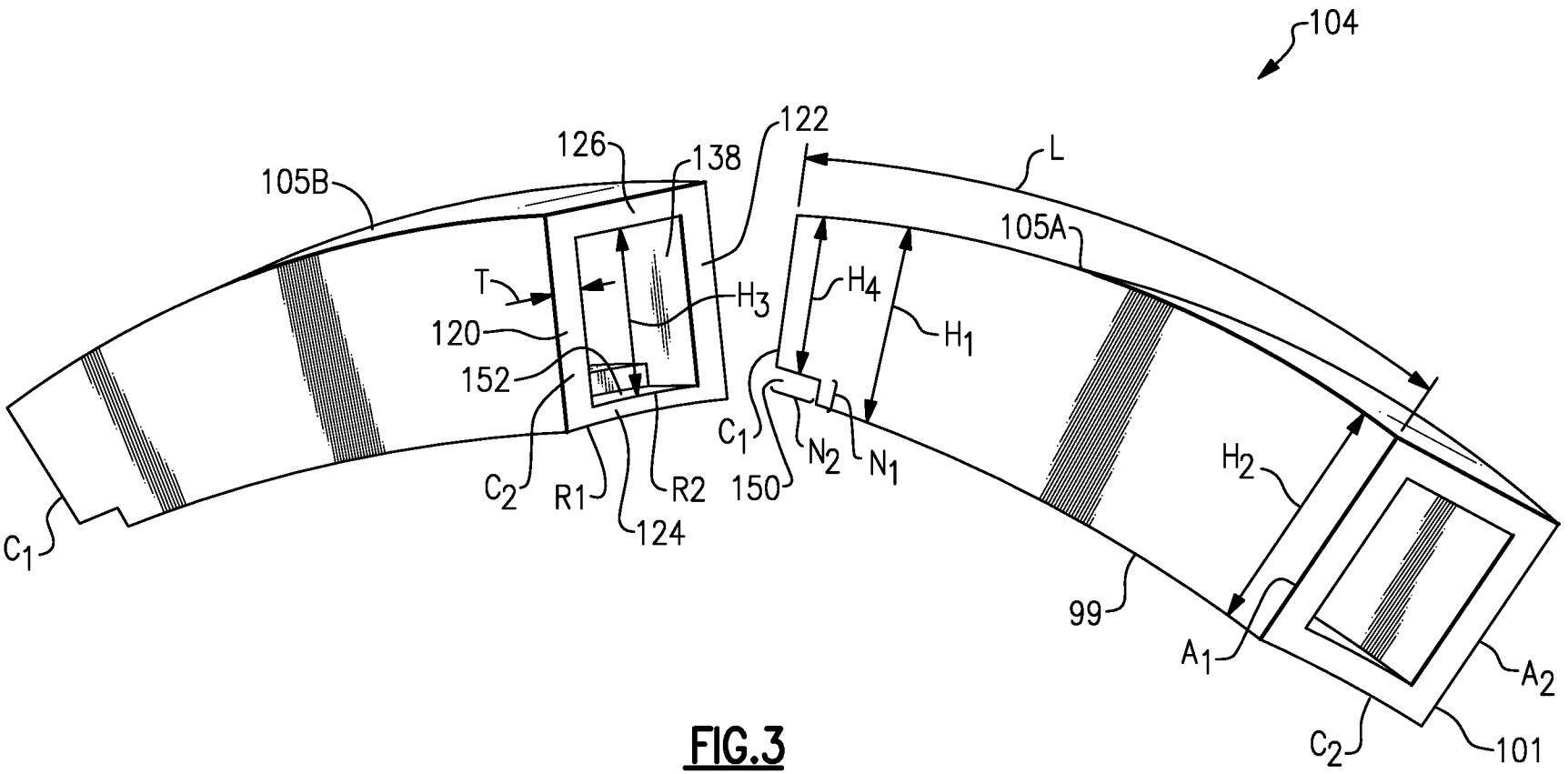
FIG. 3 shows a portion of an exemplary blade outer air seal assembly.

FIG. 3 shows a portion of an example BOAS assembly 104. The assembly 104 has a plurality of seal segments 105. The illustrated example shows a first seal segment 105A and a second seal segment 105B. The seal segments 105A and 105B have the same structure. In some examples, additional features, such as holes or hooks on the seal segments 105 may be used for mounting the seal segments 105 to the engine 20.

Each seal segment 105A, 105B is a body that defines radially inner and outer sides R1, R2, respectively, first and second axial sides A1, A2, respectively, and first and second circumferential sides C1, C2, respectively. The radially inner side R1 faces in a direction toward the engine central axis A. The radially inner side R1 is thus the gas path side of the seal segment 105 that bounds a portion of the core flow path C. The first axial side A1 faces in a forward direction toward the front of the engine 20 (i.e., toward the fan 42), and the second axial side A2 faces in an aft direction toward the rear of the engine 20 (i.e., toward the exhaust end). That is, the first axial side A1 corresponds to a leading edge 99, and the second axial side A2 corresponds to a trailing edge 101.

In the illustrated example, the BOAS segment 105 is a "box" style BOAS. Each seal segment 105A, 105B includes a first axial wall 120 and a second axial wall 122 that extend radially outward from a base portion 124. The first and second axial walls 120, 122 are axially spaced from one another. Each of the first and second axial walls 120, 122 extends along the base portion 124 in a generally circumferential direction along at least a portion of the seal segment 105. The base portion 124 extends between the leading edge 99 and the trailing edge 101 and defines a gas path on a radially inner side and a non-gas path on a radially outer side. An outer wall 126 extends between the first and second axial walls 120, 122. The outer wall 126 includes a generally constant thickness and constant position in the radial direction. The base portion 124, first and second axial walls 120, 122, and the outer wall 126 form a passage 138 that extends in a generally circumferential direction. In this disclosure, forward, aft, upstream, downstream, axial, radial, or circumferential is in relation to the engine axis A unless stated otherwise.

Each seal segment 105A, 105B is tapered over a length L in the circumferential direction to provide different heights in the radial direction. For example, a first height $H_1$ near the first circumferential side C1 is smaller than a second height $H_2$ near the second circumferential side C2. The passage 138 has a third height $H_3$. The third height $H_3$ is sized to receive the first circumferential side C1 of an adjacent seal segment 105. That is, the first circumferential side C1 has an outer height that is less than an inner height $H_3$ of the second circumferential side C2. The passage 138 may have the same height $H_3$ over the length L of the seal segment 105, or may be slightly tapered. Having a taper in the passage 138 may simplify manufacturing, for example. The base portion 124 and walls 120, 122, 126 may have the same thickness T in some examples.

The seal segment 105 tapers from the second circumferential side C2 to the first circumferential side C1 may be about 0.01 inches (0.254 mm) in the radial direction for every inch (2.54 mm) of length L in the circumferential direction. The length L may be about 2 to 16 inches (50.8-406.4 mm). In a further example, the length L may be about 4 to 6 inches (101.6-152.4 mm). Thus, the difference between heights $H_1$ and $H_2$ may be about 0.04-0.06 inches (1.016-1.524 mm), for example. In another embodiment, the difference between heights $H_1$ and $H_2$ may be about 0.02-0.3 inches (0.508-7.62 mm). In some examples, the difference between heights $H_1$ and $H_2$ may be about the same as the thickness T. In one example, the thickness T is between about 0.02 and 0.25 inches (1.016-6.35 mm). In a further example, the thickness is between about 0.04 and 0.13 inches (1.016-3.302 mm). In a further example, the thickness T is about 0.10 inches (2.54 mm). In one example, the taper from the second circumferential side C2 to the first circumferential side C1 is between about 0.1° and about 15°. In another embodiment, the taper is between about 1° and about 10°.

In some embodiments, the seal segments 105A, 105B have a notch 150 formed in the first circumferential side C1. The notch 150 is arranged on the base portion 124. In some embodiments, a notch may also be formed on the outer wall 126. The notch 150 defines a fourth height $H_4$ of the seal segment 105A in the radial direction. The height $H_4$ is smaller than the first and second heights $H_1$, $H_2$. In one example, the height $H_4$ is slightly smaller than the height $H_3$ of the passage 138, such that the first circumferential side C1 of the first seal segment 105A fits within the passage 138 of the second seal segment 105B. The notch 150 has a height $N_1$ in the radial direction, and a width $N_2$ in the circumferential direction. The height $N_1$ may be about the same as the thickness T, in some examples. The width $N_2$ determines the amount of the first seal segment 105A that fits into the passage 138. The notch 150 provides a relatively smooth radially inner surface for the blades 102 to pass by during engine operation.

In some examples, the base portion 124 may also be have a notch 152 to provide an improved fit between the two segments 105A, 105B near the gas path surface. The notches 150 and 152 may be formed either by the forming of the composite by 2D ply layup or 3D weaving or be later added to the components by machining processes depending on the tolerances required.

This arrangement of having a first circumferential side C1 of a first seal segment 105A fit within a second circumferential side C2 of a second seal segment 105B provides a nesting arrangement about the engine axis A. This arrangement may minimize hot gas leakage. The nesting seal segments 105A, 105B are self-sealing with one another, and may be used with or without an additional intersegment seal, for example. In one example, the segments 105 are sealed on all four sides about the passage 138. Such a sealing arrangement may provide lower pressure cooling air control in the passage 138, which may be more efficient.

The seal segments 105A, 105B may be formed of a ceramic matrix composite ("CMC") material. Each seal segment 105 is formed of a plurality of CMC laminates. The laminates may be silicon carbide fibers, formed into a braided or woven fabric in each layer. The fibers may be coated by boron nitride and/or other ceramic layers. In other examples, the seal segments 105 may be made of a monolithic ceramic.

CMC components such as BOAS segments 105 could be formed by laying fiber material, such as laminate sheets, in tooling, injecting a liquid resin into the tooling, and curing to form a solid composite component. The laminates may be SiC—SiC sheets, for example. The component may be densified by adding additional material to further stiffen the laminates. The component may be formed using one or more of polymer infiltration, melt infiltration, or chemical vapor infiltration (CVI), for example. In one example, the fiber material is oxide-oxide CMC.

In an example embodiment, the BOAS segment 105 has a constant wall thickness of about 4-12 laminated plies, with each ply having a thickness of about 0.011 inches (0.279 mm). This structure may reduce thermal gradient stress. In other embodiments, the BOAS may be constructed of more or fewer plies. In some examples, additional reinforcement plies may be provided in the base portion 124, and thus the base portion 124 will have a larger thickness than the walls 120, 122, 126.

In one example, the seal segment 105 is formed from laminates wrapped around a core mandrel. The core mandrel may be a plastic, graphite or metallic molding tool. In some embodiments, after the laminate plies are formed into a seal segment 105, additional features, such as notch 150 are machined into the body. The seal segment 105 may be ultrasonically machined, for example.

Figure 4:
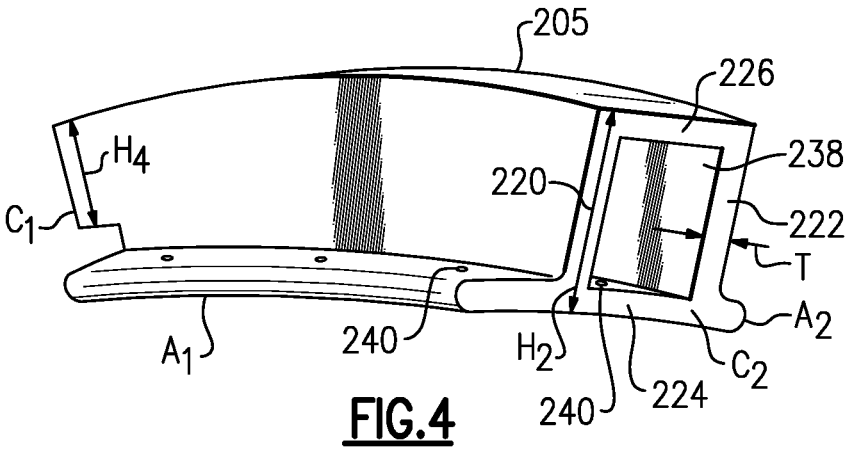
FIG. 4 shows an exemplary blade outer air seal.

FIG. 4 illustrates another example BOAS segment 205. In some embodiments, the base portion 224 may extend axially forward and/or aft of the first and second walls 220, 222. Additional seals, such as a front brush seal, a diamond seal, or a dogbone seal may be engaged with the leading and/or trailing edge of the seal segment 205, and help maintain the axial position of the seal segment 205. In some examples, film cooling holes 240 are provided in the base portion 224. The film cooling holes 240 may be within the passage 238, or forward and/or aft of the first and second walls 220, 222.

Figure 5:
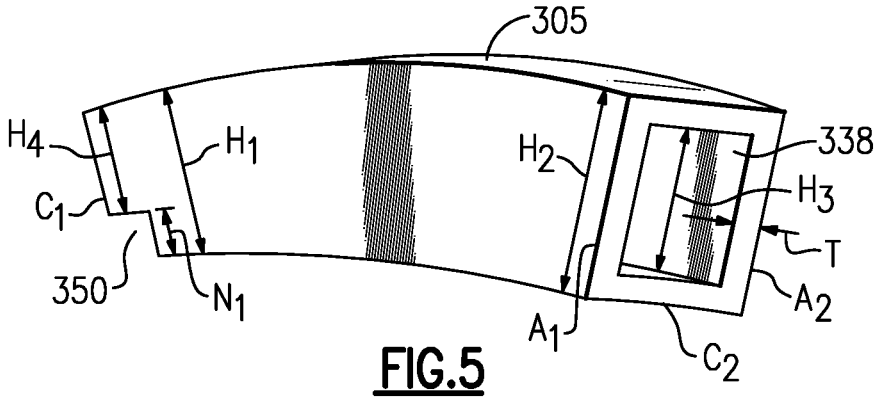
FIG. 5 shows an exemplary blade outer air seal.

FIG. 5 illustrates another example BOAS segment 305. In this example, the height $H_1$ is substantially equal to the height $H_2$. That is, the segment 305 is not tapered between the first and second ends C1, C2. The height $H_4$ at the first circumferential end C1 that is sized to fit within the height $H_3$ of the passage is formed from the notch 350. In some examples, although the heights $H_1$, $H_2$ are substantially equal, the passage 138 may include a slight taper. This is for ease of manufacturing. The height $H_1$ is equal to the height $H_4$ plus the notch height $N_1$. In some examples the notch height $N_1$ is about equal to the thickness T. The height $H_4$ is the same as, or slightly smaller than, the height $H_3$ of the passage 338.

Figure 6:
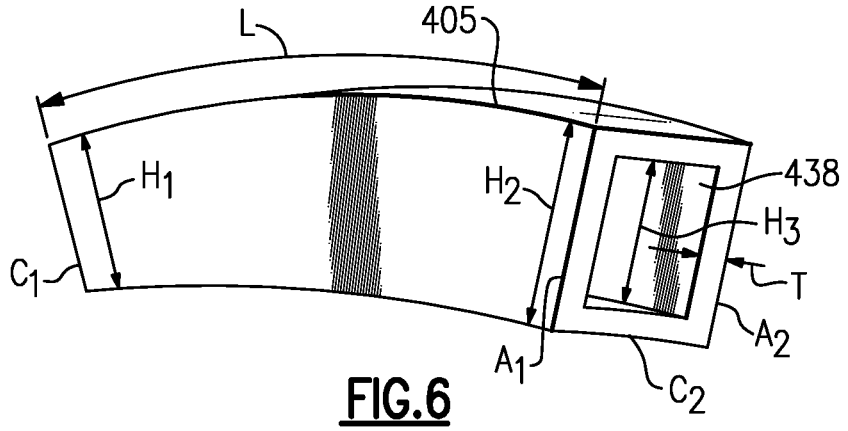
FIG. 6 shows an exemplary blade outer air seal.

FIG. 6 illustrates another example BOAS segment 405. In this example, the first circumferential side $C_1$ does not include a notch. The seal segment 405 is tapered enough that the height $H_1$ fits within the passage 438. The difference between the heights $H_2$ and $H_1$ may be about twice the thickness T. That is, the height $H_3$ plus twice the thickness T is equal to the height $H_2$. This embodiment may not provide as smooth of a radially inner surface for the turbine blades 102 to pass by, but provides for simpler manufacturing.

The disclosed BOAS arrangement provides seal segments that interlock with adjacent seal segments to form a sealed ring. Each BOAS segment locks with an adjacent BOAS segment to form a tight fitted ring, which may improve sealing between seal segments 105. This arrangement also allows each seal segment 105 to support another seal segment, and thus may provide reduced need for attachment structure to the rest of the engine. For example, the segments 105 may support one another in the radial direction, and thus only need the support structure to locate the BOAS in the axial direction.

This arrangement may be particularly beneficial for CMC BOAS segments 105. CMC materials are hard, and may thus wear other surrounding structures more quickly. CMC is also relatively brittle, and may thus require protection against point loads. The disclosed seal segment arrangement thus provides load sharing and self-centering seal segments that have improved fit and sealing with adjacent components.

Figure 7:
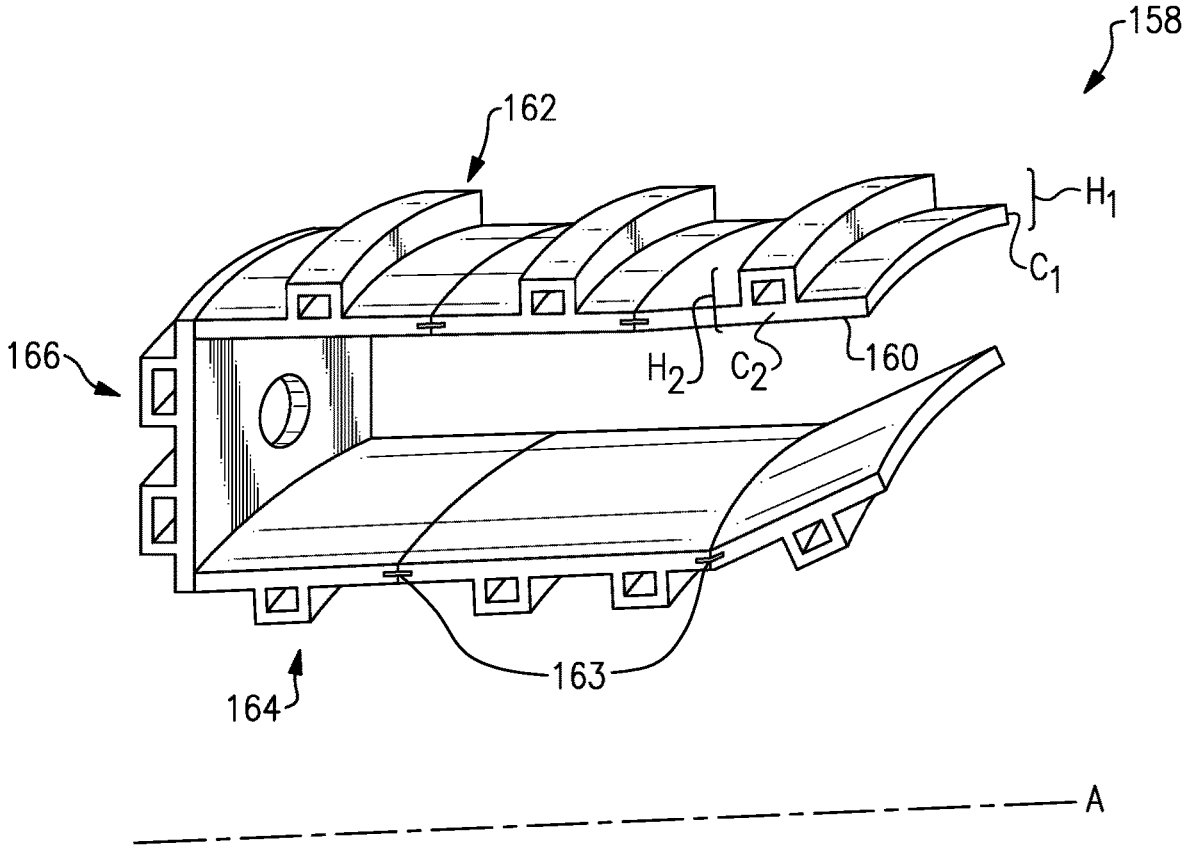
FIG. 7 shows a portion of an exemplary combustor section.

The disclosed nesting arrangement may also be beneficial in other engine components, such as combustors. FIG. 7 illustrates a portion of an example combustor assembly 158. The combustor assembly 158 may be incorporated into combustor section 26, for example. In this example, the combustor assembly 158 may be a full annular combustor arranged about the engine axis A. The combustor assembly 158 is formed from a plurality of combustor segments 160. In one example, combustor segments 160 are arranged to form an outer diameter section 162, an inner diameter section 164, and an endwall section 166. In some examples, a seal 163 is arranged between each of the combustor segments 160.

Each of the combustor segments 160 has first and second circumferential sides C1, C2. The first circumferential side C1 has a height $H_1$ and the second circumferential side C2 has a height $H_2$. The height $H_1$ of the first circumferential side C1 is smaller than the height $H_2$ of the second circumferential side C2 to enable nesting between adjacent combustor segments 160 in the circumferential direction. That is, the first circumferential side C1 is configured to fit within the second circumferential side C2 of an adjacent segment 160. The different heights $H_1$, $H_2$ may be formed from a taper or machined notch, for example. This nesting arrangement may be utilized in the outer diameter section 162, the inner diameter section 164, and/or the endwall section 166. In some examples, the different sections 162, 164, 166 may have different nesting arrangements, such as tapered or notched, from one another.

The disclosed nesting arrangement may allow for manufacture of the segments 160 in smaller sizes, which may improve yield. This arrangement may also permit individual segments to be replaced, and may minimize the attachment requirements to the engine case. In this disclosure, "generally axially" means a direction having a vector component in the axial direction that is greater than a vector component in the circumferential direction, "generally radially" means a direction having a vector component in the radial direction that is greater than a vector component in the axial direction and "generally circumferentially" means a direction having a vector component in the circumferential direction that is greater than a vector component in the axial direction.

Although an embodiment of this invention has been disclosed, a worker of ordinary skill in this art would recognize that certain modifications would come within the scope of this disclosure. It is possible to use some of the components or features from one of the examples in combination with features or components from another one of the examples. For that reason, the following claims should be studied to determine the true scope and content of this disclosure.

The invention claimed is:

1. A component for a gas turbine engine, comprising:

a body having a first circumferential side extending radially to establish a first height, a second circumferential side extending radially to establish a second height, and a circumferentially extending passage extending from the first circumferential side to the second circumferential side, wherein the circumferentially extending passage is defined by a base portion, first and second axial walls, and an outer wall, and wherein the outer wall is opposite to the base portion;

wherein the first height and the second height extend radially from a radially inner side of the base portion to a radially outer side of the outer wall of the respective first and second circumferential sides;

wherein the circumferentially extending passage has an opening along the second circumferential side, and the opening extends radially between the base portion and the outer wall to establish a third height;

wherein the body is tapered from the second circumferential side to the first circumferential side such that the first height is less than both the second and third heights and wherein the first circumferential side is insertable through an opening of an adjacent body.

2. The component of claim 1, wherein the base portion extends axially forward of the first axial wall.

3. The component of claim 1, wherein the body defines an angle between the first circumferential side and the second circumferential side between about 0.1° and about 15°.

4. The component of claim 1, wherein a notch is arranged at the first circumferential side to define a fourth height.

5. The component of claim 1, wherein the body has a circumferential length between the first and second circumferential sides that is between about 2 and about 16 inches (50.8-406.4 mm).

6. The component of claim 1, wherein the circumferentially extending passage is defined by walls each having a thickness of about 0.02 to 0.25 inches (1.016-6.35 mm).

7. The component of claim 1, wherein a difference between the first height and the second height is about 0.02 to 0.3 inches (0.508-7.62 mm).

8. The component of claim 1, wherein the body is a ceramic matrix composite material.

9. The component of claim 8, wherein the body is formed from a plurality of fibrous woven or braided plies.

10. A turbine section for a gas turbine engine, comprising:

a turbine blade extending radially outwardly to a radially outer tip and for rotation about an axis of rotation;

a blade outer air seal having a plurality of seal segments arranged circumferentially about the axis of rotation and radially outward of the outer tip;

each seal segment having a first circumferential side extending radially to establish a first height and a second circumferential side extending radially to establish a second height, and each seal segment has a taper from the second circumferential side to the first circumferential side such that the first height is less than the second height; and a circumferentially extending passage extending from the first circumferential side to the second circumferential side, wherein the circumferentially extending passage has an opening along the second circumferential side; and the first circumferential side arranged through the opening and partially within the circumferentially extending passage of an adjacent one of the seal segments.

11. The turbine section of claim 10, wherein the taper defines an angle between the first circumferential side and the second circumferential side between about 0.1° and about 15°.

12. The turbine section of claim 10, wherein a notch is arranged at the first circumferential side to define a third height.

13. The turbine section of claim 10, wherein the circumferentially extending passage is defined by a base portion, first and second axial walls, and an outer wall, and the base portion extends axially forward of the first axial wall.

14. The turbine section of claim 10, wherein the seal segment is a ceramic matrix composite material.

15. A combustor section for a gas turbine engine, comprising:

a combustor chamber disposed about an engine central axis and formed from a plurality of segments; and at least one of the segments having a first circumferential side extending radially to establish a first height and a second circumferential side extending radially to establish a second height, each of the segments having a taper from the second circumferential side to the first circumferential side such that the first height is less than the second height; and a circumferentially extending passage extending from the first circumferential side to the second circumferential side, wherein the circumferentially extending passage has an opening along the second circumferential side, and the first circumferential side is arranged through the opening and partially within the passage of an adjacent one of the segments.

* * * * *